US007122972B2

(12) United States Patent
Poon et al.

(10) Patent No.: US 7,122,972 B2
(45) Date of Patent: Oct. 17, 2006

(54) DIMMABLE BALLAST WITH RESISTIVE INPUT AND LOW ELECTROMAGNETIC INTERFERENCE

(75) Inventors: Franki Ngai Kit Poon, Hong Kong (CN); Man Hay Pong, Hong Kong (CN); Joe Chiu Pong Liu, Hong Kong (CN)

(73) Assignee: University of Hong Kong, Hong Kong (HK)

( * ) Notice: Subject to any disclaimer, the term of this patent is extended or adjusted under 35 U.S.C. 154(b) by 351 days.

(21) Appl. No.: 10/796,108

(22) Filed: Mar. 10, 2004

(65) Prior Publication Data

US 2005/0110429 A1 May 26, 2005

Related U.S. Application Data

(60) Provisional application No. 60/518,880, filed on Nov. 10, 2003.

(51) Int. Cl.
*H05B 37/02* (2006.01)

(52) U.S. Cl. ..... 315/209 R; 315/276; 315/244

(58) Field of Classification Search ..... 315/274, 315/276, 279, 282, 291, 244, 209 R
See application file for complete search history.

(56) References Cited

U.S. PATENT DOCUMENTS 4,585,974 A * 4/1986 Stupp et al. ..... 315/307
5,065,072 A * 11/1991 Albou et al. ..... 315/82
5,510,681 A * 4/1996 Nilssen ..... 315/219
5,841,239 A * 11/1998 Sullivan et al. ..... 315/219
6,483,256 B1 * 11/2002 Heckmann ..... 315/276
6,545,431 B1 * 4/2003 Hui et al. ..... 315/291
2002/0033679 A1 * 3/2002 Hui et al. ..... 315/307
2005/0035723 A1 * 2/2005 Muramatsu et al. ..... 315/276
2005/0110431 A1 * 5/2005 Ben-Yaakov ..... 315/291

* cited by examiner

*Primary Examiner*—Tuyet Vo
*Assistant Examiner*—Tung Le
(74) *Attorney, Agent, or Firm*—Dickstein, Shapiro, LLP.

(57) ABSTRACT

An AC to AC power conversion apparatus with constant power feeding characteristics to fluorescent lamp or FD lamp is described. The constant power characteristic is achieved by discontinuous mode operation of capacitor coupled in series with the load. Packets of energy are pumped out to the load in each switching cycle, regardless of the resonant characteristics. The dependence of the input power on the square of the supply voltage make the input resistive and produces good power factor automatically. The lamp load is dimmable by external phase control dimmer like resistive incandescent lamps. Multiple lamp loads with different power rating can be integrated by adding more sets of said capacitors and associated components.

16 Claims, 4 Drawing Sheets

Input AC voltage waveform across $AC_{101}$ and $AC_{102}$

Input rectified voltage waveform across $V_{101}$ and $V_{100}$

Input current waveform

DIMMABLE BALLAST WITH RESISTIVE INPUT AND LOW ELECTROMAGNETIC INTERFERENCE

CROSS REFERENCE

This application claims the benefit of U.S. Provisional Application No. 60/518,880 filed Nov. 10, 2003.

FIELD OF THE INVENTION

This invention relates to the field of power converters, in particular to the field of AC to AC conversion for ballast or gas discharge lamps such as fluorescent lamp, cold cathode fluorescent lamp or HID lamps. This converter has resistive input characteristic which produces high power factor and is dimmable by an external phase-controlled dimmer.

BACKGROUND OF THE INVENTION

Electronic ballast is widely used because of its advantages of high efficiency, energy saving and compact size. However, it is still not as popular as the conventional magnetic ballast. This is because electronic ballasts are often compared directly with magnetic ballast, both in terms of performance and cost. An electronic ballast has to meet many regulations for lighting apparatus such as those for input harmonic current, power factor, total harmonic distortion. Very often high-performance and expensive components are required in order to meet these regulations. For example, high voltage electrolytic bulk capacitor are usually needed in a ballast circuit, but the life time of most high voltage electrolytic capacitor is 2,000 hours at rated condition, which is only half the life time of a tube type fluorescent lamp. So there is very tough trade off between cost and reliability of an electronic ballast.

A typical prior art ballast circuit is shown in FIG. 1. It consists of a rectifier, a boost converter followed by a DC to AC converter. The rectifier converts the AC input to a pulsating DC source. The boost converter serves as a Power Factor Correction (PFC) front end which make sure that the input current meet the regulatory requirements. The DC to AC converter receives the DC from the PFC front end and produces a plurality of pulses by switches $M_1$ and $M_2$. The pulses are coupled to a resonant circuit which consists of a lamp load. When the pulse frequency is close to the resonate frequency of the resonate network, a lot of power will be delivered to the load. If pulse frequency is slightly shifted with respect to the resonate frequency of the resonate network, power delivery will drop. The deviation of power caused by frequency shift depends on the Q factor of the resonate network. Also the maximum current flow into the lamp depends on the series inductance $L_{res}$ and the lamp characteristic. The major drawback of this prior art is the sensitivity to component variations because resonant is key of the operation. The operating point must fall into a high gain region of the resonant characteristics otherwise the lamp would not light up properly.

When lamp dimming is needed an external phase control dimmer is often used. This calls for more complicated circuits in the ballast. Work of this type can be found from U.S. Pat. No. 5,172,034 by Brinkerhoff, U.S. Pat. No. 5,396,155 by Bezdon et al, U.S. Pat. No. 5,559,395 Venkitasubrahmanian et al, U.S. Pat. No. 6,094,017 by Adamson, U.S. Pat. No. 6,339,298 by Chen, U.S. Pat. No. 5,686,799 by Moisin, U.S. Pat. No. 5,825,137 by Titus, U.S. Pat. No. 6,100,644 by Titus, etc. The basic circuit is similar to the prior art with a power factor corrector front end in cascade with a converter to produce a pulsating voltage to a resonate circuit. Basically the idea is to generate a control signal to shift the pulse frequency along the bell shape resonate characteristic curve of the resonant circuit in order to adjust the power delivery produces dimming effect on the lamp. The control signal can be provided by an external controlling device, a potentiometer, or the average phase conduction angle voltage of an external dimmer. This type of control method cannot be very stable because the resonant circuit characteristics is very sensitive and changeable.

Some researchers attempted to solve the stability problem of dimmable ballast. Work in this area can be found from U.S. Pat. No. 5,315,214 by Lesea, U.S. Pat. No. 6,037,722 by Moisin, U.S. Pat. No. 6,118,228 by Pál, U.S. Pat. No. 6,144,169 by Janczak, U.S. Pat. No. 6,448,713 by Farkas et al, U.S. Pat. No. 6,452,344 by MacAdam et al try to sense the current lamp current and compare it with the control signal using feedback control and adjust the switching frequency to go to a stable operating point on the bell shaped resonant curve. Many complex circuits are needed, together with the power factor corrector front end the final product is not cost competitive.

Some other researchers try to use simper circuits to achieve both good power factor and dimmable effect. In U.S. Pat. No. 5,801,492 Bobel uses a single stage circuit to provide power factor correction but it requires two resonant circuits to allow energy to flow back to the rectified input side and cause high voltage stresses on the main switches. In U.S. Pat. No. 6,348,767 Chen et al use two resonate circuit and connect the lamp loading to input side to provide a small continuous current flow to hold the triac dimmer on the input side but it produces poor power factor. In U.S. Pat. No. 6,011,357 Gradzki et al use a separate circuit to keep a small continuous current flow to hold the triac dimmer on the input side with poor power factor. In U.S. Pat. No. 6,429,604 B2 Chang uses multiple LLC resonant circuit to control the input current shape and lamp current flow but voltage stress is higher than the input peak AC voltage. This produces excessive voltage stresses on the components in the circuit.

There is a need to develop a ballast to have a simple circuit, stable operation, low input current harmonic characteristic and low electrical stresses.

SUMMARY OF THE INVENTION

The present invention is a switching converter with an AC output to drive a gas discharge lamp. The switching converter delivers a pre-designed power amount, instead of producing an output voltage and let the load determine the power. The instantaneous power is proportional to the square of input voltage, which is true for the input power as well. Hence, the input impedance becomes resistive. If an AC source is rectified and connected to the converter, the input current will follow the input AC voltage waveform and controlled by the equivalent resistance of the converter.

The converter in the present invention comprises of capacitors and a lamp load. A plurality of pulses charges and discharges the capacitors through the lamp load in each cycle. The capacitor charging determines the amount of power delivered to the lamp, and such charging behavior is not sensitive to the lamp characteristics. This configuration provides automatic power factor correction. Packets of energy are delivered to the lamp which can be controlled by the switching frequency and the design of the capacitors.

It is an object of the present invention to be dimmable by an external triac phase control dimmer.

It is another object of the present invention to adjust the power delivery to the load by switching frequency.

It is another object of the present invention to eliminate the need for a bulk converter.

It is another object of the present invention to reduce losses at high frequency switching.

It is another object of the present invention to reduce high frequency switching noise.

It is another object of the present invention to have a simple converter topology with input power factor correction characteristic without an additional converter.

These and other objects of the present invention will become apparent to those skilled in the art from the following detailed description of the invention and the accompanying drawings.

DETAILED DESCRIPTION OF THE PREFERRED EMBODIMENTS

Figure 1:
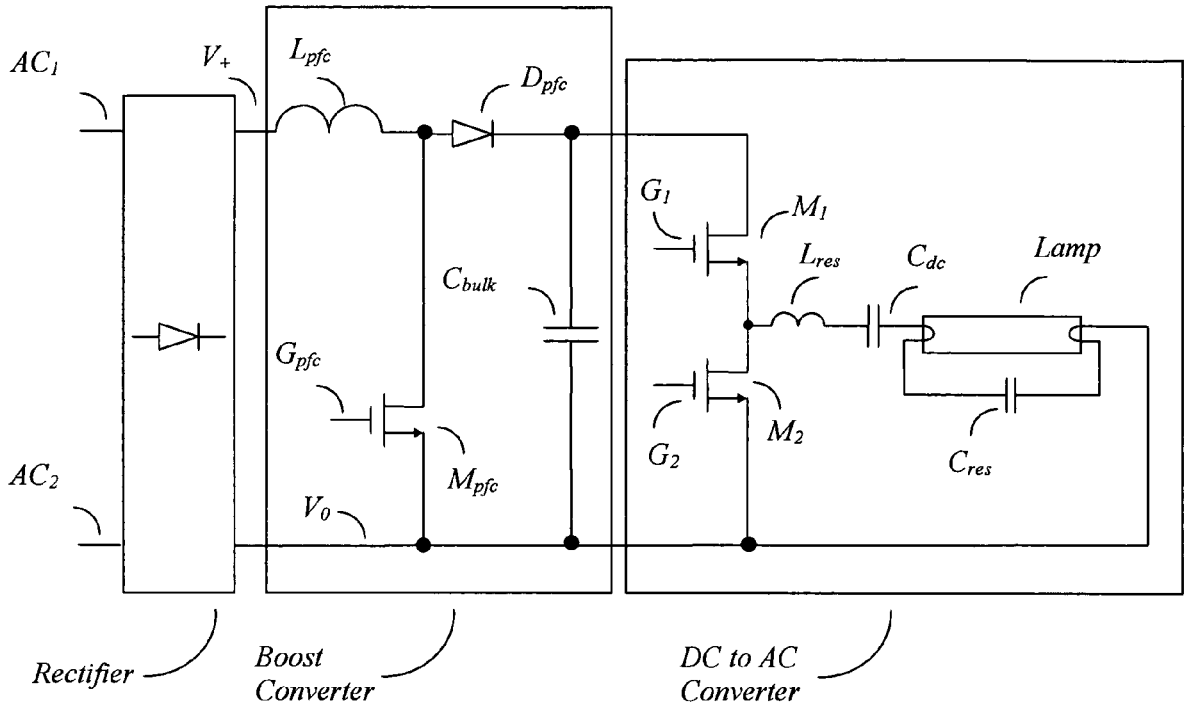
Figure 1 (Prior Art)
FIG. 1 shows a conventional simplified ballast circuit.

The principle of the invention is described herein. A set of complementary electronic switches connected to a voltage source generates a plurality of pulses which are then injected into one or more constant power modules. Each module comprises of two series capacitors coupled to the power supply rail. Each capacitor has an anti-parallel diode. The junction of the capacitor is coupled to a load and then the injection of pulses. Effectively the capacitors are charged and discharged through the load. When the capacitor is charged, energy will be delivered to the load. Consider the case of charging a capacitor from 0V. The parameters are capacitance C with series load Rs and a voltage source $V_s$. Let the energy expended on the series load Rs during charging be $E_{Rs_c}$. The total energy deliver to the whole circuit is the integration of voltage $V_s$ and the current $i_{in}$ with respect to time which is equal to the energy stored in the capacitor and energy expended on the series load, as represented by equation 1.

$$\int_o^\infty V_s i_{in}\, dt = \frac{1}{2}CV_s^2 + E_{\mathrm{Rs_c}}, \qquad \text{Equation 1}$$

The total charge $Q_c$ storage in the capacitor C is, $$\int_0^\infty i_{in}\, dt = Q_c, \qquad \text{Equation 2}$$

Combining Equation 1, Equation 2 and by the definition of capacitance $$\int_o^\infty V_s i_{in}\, dt = V_s Q_c = V_s C V_s, \qquad \text{Equation 3}$$

the energy $E_{Rs_c}$ expended on the series load while charging the corresponding capacitor to the supplied voltage is $$E_{\mathrm{Rs_c}} = \frac{1}{2}CV_s^2 \qquad \text{Equation 4}$$

This shows the energy expended in fully charge a capacitor with a series resistor is equal to the energy stored in the capacitor.

If the capacitor is completely discharged through the series load, all the energy stored in the capacitor will be expended at the load and is also equal to $$\frac{1}{2}CV_s^2.$$

Hence the total energy delivered to the series load in a complete charge and discharge cycle is $CV_s^2$.

One has also to be reminded that the series load characteristics has not been defined, it can be a linear load such as a resistor, or a non-linear load such as lamp load or reactive load. Anyway the above result is still valid.

As the lamp load is in series with the capacitors and the capacitor voltage is clamped by the supply voltage, the energy expended on the load is fixed and proportional to the square of the supply voltage. The averaged power expenditure $P_{Rs}$ is then determined by the switching frequency fs of the complementary switches, or simply $$P_{Rs} = CfsV_{dc}^2 = \frac{V_{dc}^2}{\frac{1}{Cfs}}. \qquad \text{Equation 5}$$

It can be observed from Equation 5 that the power expenditure at the series load or power losses of the whole circuit has the form of a resistive load, with equivalent average resistance $R_{eq}$ of $$R_{eq} = \frac{1}{Cfs}$$

no matter what actually the series load is.

In this invention a switching power supply mechanism is made independent of the lamp characteristic and resonate behavior. There must be enough time for the capacitors to charge and discharge completely. This provides great flexibility on the circuit design.

In the design of the apparatus there must be sufficient voltage to start up and sustain the gas discharge lamp load. A transformer is needed in the apparatus to provide such a voltage. The transformer can be magnetic coupled type, piezoelectric type, or other appropriate forms to produce the required voltage.

The output of the transformer is a center tap configuration with center leg connected to the return path of the circuit. Each terminal of the gas discharge lamp load will have an opposite phase voltage with respect to the zero potential earth with an attempt to nullify current flowing out of the center tap terminal. This reduces Electromagnetic Interference Emission.

A series inductor is also added in series to the said capacitors to adjust the charge or discharge process.

When an AC is applied to the circuit, the AC input will see a resistive input with good power factor. It can also be dimmed by a generic triac phase control dimmer as if it was an incandescent lamp. No large electrolytic capacitor is needed and this cut down component count and cost, and provides better life time and reliability.

Figure 2A:
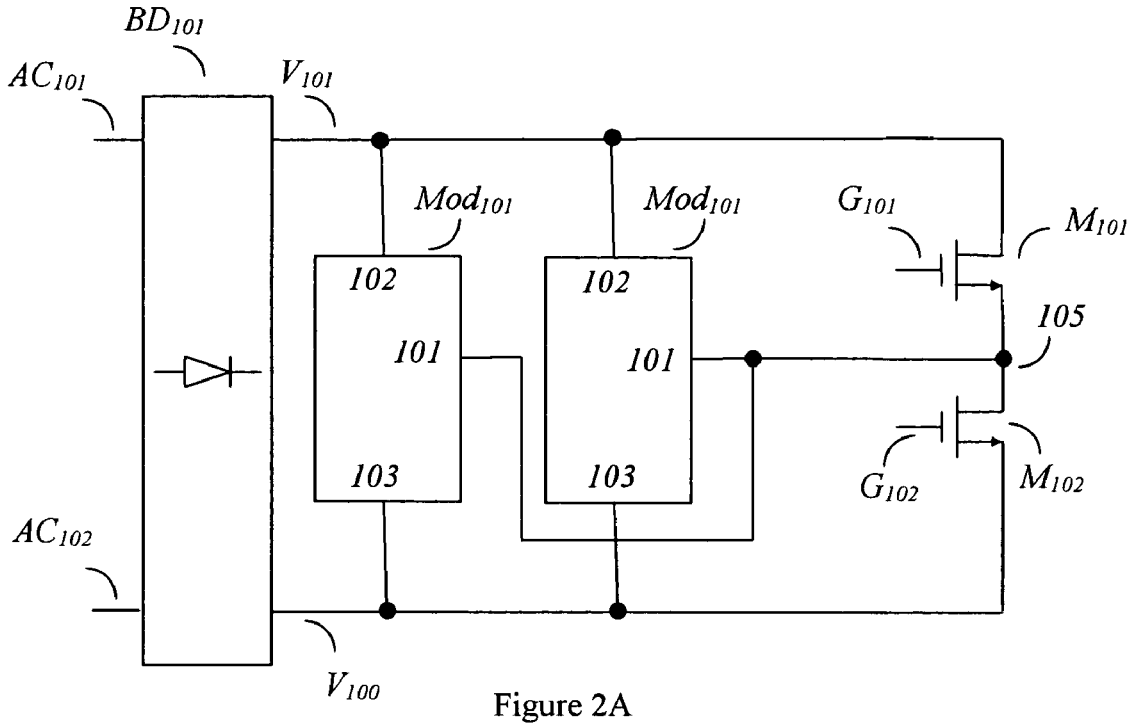
FIGS. 2A and 2B are a simplified block diagram and a circuit schematics of the present invention.
Figure 2B:
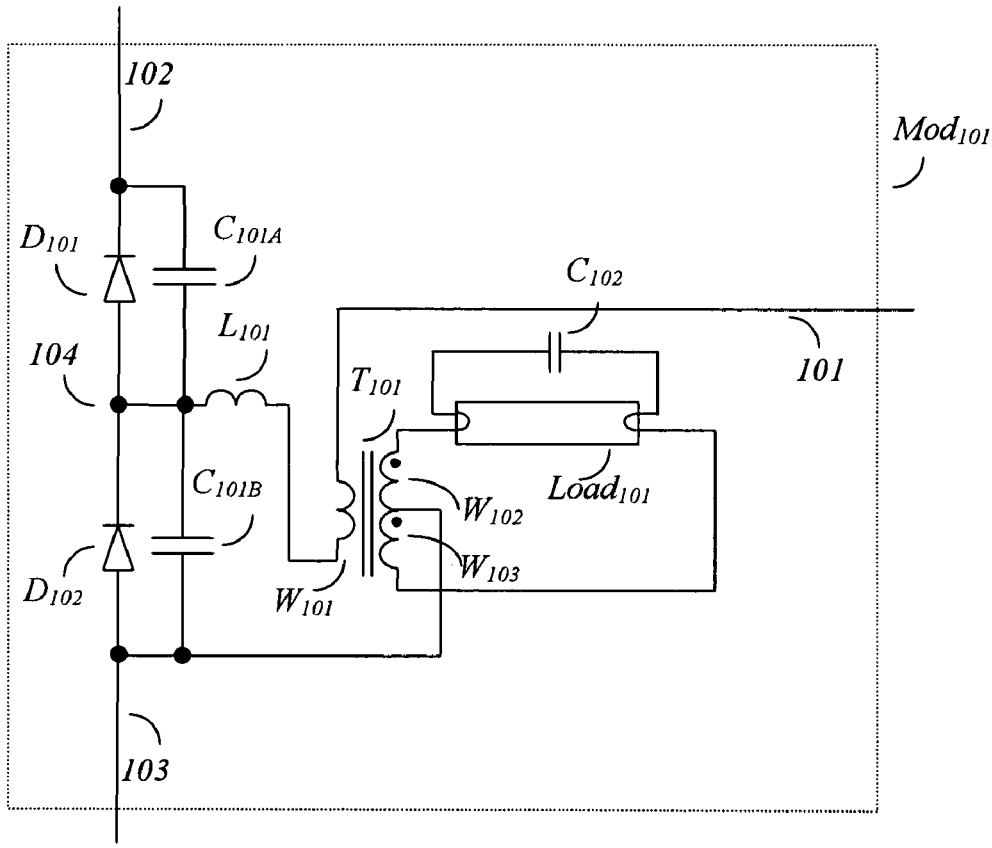

A preferred embodiment of the invention is shown in FIGS. 2A and 2B. FIG. 2A shows a simplified block diagram. It comprises of a plurality of load modules. Each load module $Mod_{101}$ is connected to a lamp load and delivers a determined amount of power to the load. Hence the number of gas discharge lamp loading is very flexible by adding on modules to the supply rails. Each module receives a plurality of voltage pulses generated by a set of complementary electronics switches coupled to a DC voltage source. The electronic switches can be any appropriate power semiconductor devices such as MOSFET, IGBT or transistor. The DC voltage is rectified from an external AC source through an AC to DC rectifier such as a bridge rectifier or a full wave rectifier. The rectified voltage provides a waveform with an envelop following the AC input waveform, which maintains high power factor. No large reservation capacitor is necessary to hold the peak voltage waveform from the rectified voltage.

FIG. 2B shows the load module. It comprises of two series capacitor connected across the supply rail. Each of them has an anti-parallel diode and they clamp the voltage swing of each capacitor within the supply voltage. The junction of the capacitors is coupled to a load through an inductor, which is in turn coupled to a plurality of voltage pulses. The load is often a transformer coupled load where the lamp is coupled to the centre-tap secondary winding. The capacitance of the capacitor is designed to ensure discontinuous operation which is charged and discharged within the supply voltage. Hence the total power pumped to the load is fixed by the value of the capacitor and the supply voltage. The charge and discharge current waveform is related to the equivalent load. While the imposed voltage pulses charge and discharge the capacitor and make its voltage swing between the converter supply rails, power will be delivered to the load. The said series inductor coupled to the capacitors adjust the charge and discharge current waveform to modify the current crest factor of the lamp load which does not affect the basic operation too much. In some cases it can be replaced by a short circuit.

The secondary winding of the said transformer belongs to the center tap type. It has two secondary windings with opposite phase and they produce sufficient voltage to strike on the lamp. The arrangement of opposite phases on these windings nullifies the current flow out the centre tap and reduces Electromagnetic Interference.

The operating waveforms are explained herein. Nodes $AC_{101}$ and $AC_{102}$ in FIG. 2A receive an ac voltage as shown in FIG. 4A, the AC voltage are rectified as shown in FIG. 4B and applied to a pair of complementary switches $M_{101}$ and $M_{102}$. Switches $M_{101}$ and $M_{102}$ are turned on and turn off according to gate driving signal applied on $G_{101}$ and $G_{102}$ as shown in FIG. 3A and FIG. 3B.

Figure 3:
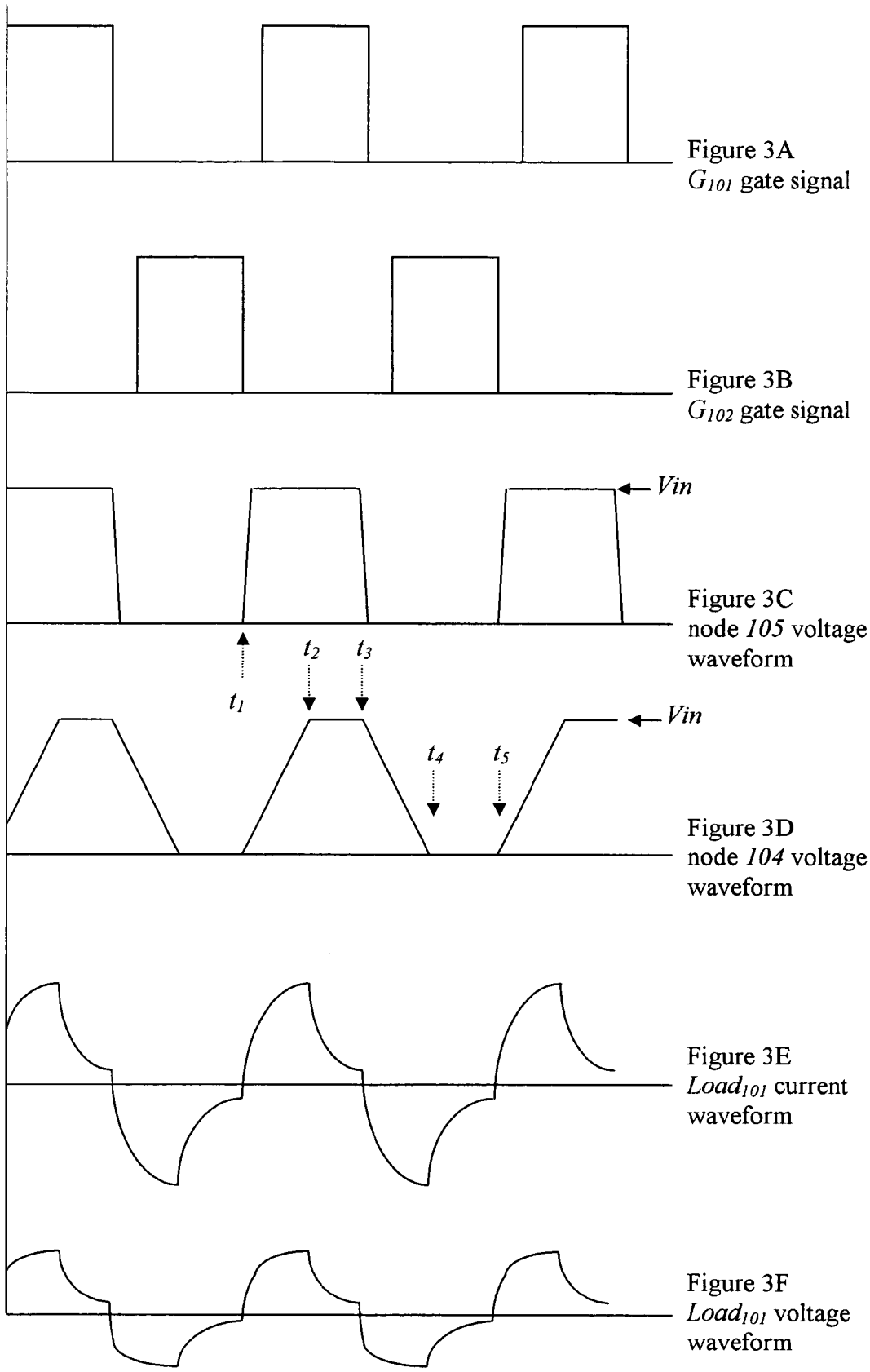
FIGS. 3A to 3F are diagrams of high frequency voltage and current for the embodiment.
Figures 4, 4A, 4B, 4C:
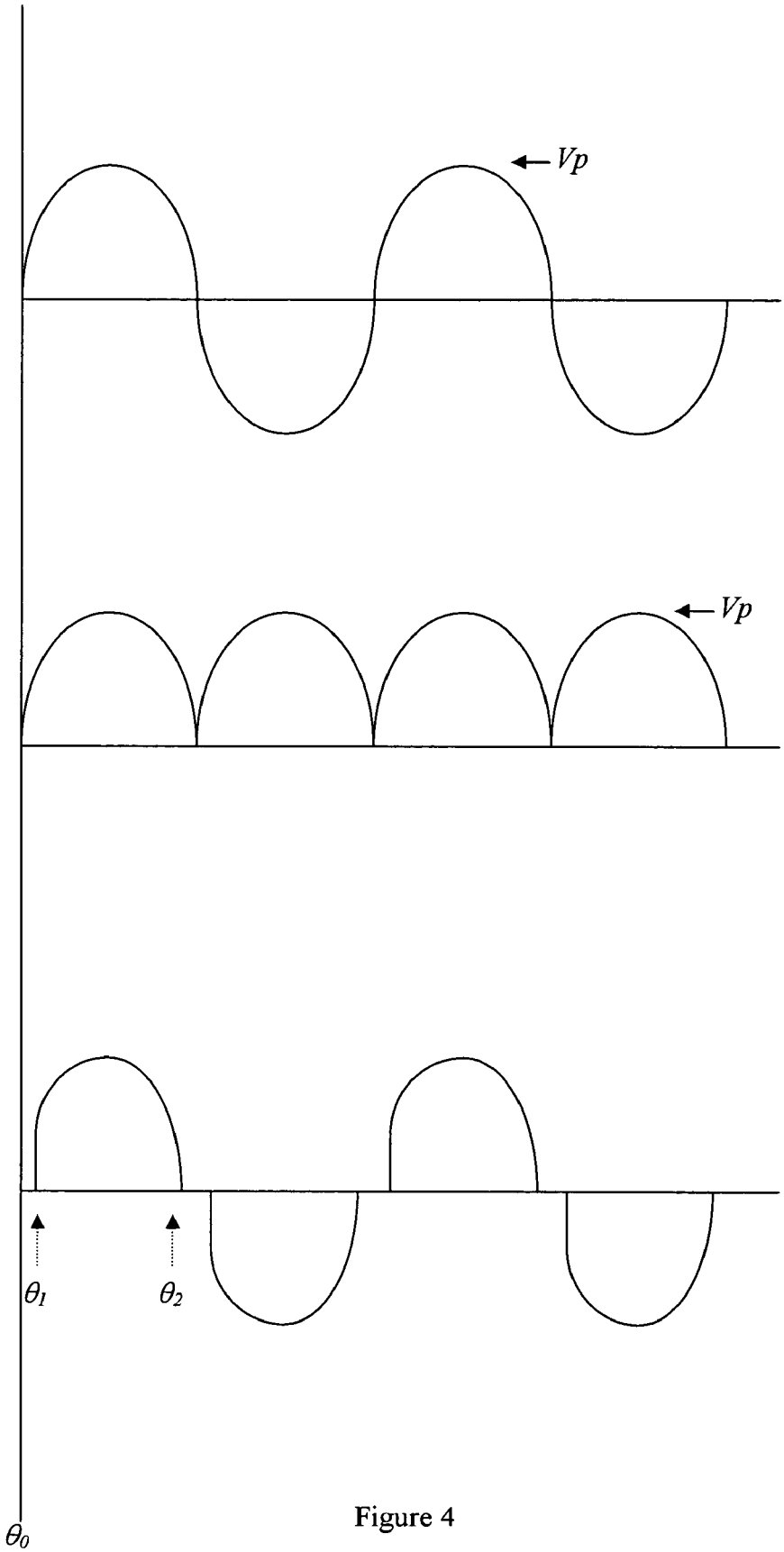
FIGS. 4A to 4C are diagrams of line frequency voltage and current for the embodiment.

In the switching time scale the center node 105 of switches $M_{101}$ and $M_{102}$ delivers a plurality of pulses with peak voltage $V_{in}$ to a series of module $Mod_{101}$ as shown on FIG. 3C. At time $t_1$, the pulse starts to rise as switch $M_{102}$ turns off Capacitor $C_{101B}$ starts to be charged up and capacitor $C_{101A}$ starts to be discharged. As capacitor $C_{101B}$ will be fully charged up and clamped by the parallel diode $D_{102}$ to supply voltage $V_{in}$, and capacitor $C_{101A}$ will be fully discharged from supply voltage $V_{in}$ to a diode drop or virtually 0V at the time $t_2$. During the time period between $t_1$, and $t_2$, charging current through will flow through the primary winding $W_{101}$ of the transformer $T_{101}$, and producing a current injecting to the lamp loading $Load_{101}$. The charging current mainly depends on the series impedance formed by the inductor $L_{101}$, reflected impedance on winding $W_{101}$ of the $Load_{101}$ and the equivalent parallel capacitance of $C_{101A}$ and $C_{101B}$. During the time period between $t_2$ and $t_3$, inductor $L_{101}$ will try to keep the current flow to avoid a sudden drop of the load current which may generate electromagnetic interference and affect the loading current crest factor.

In the time period between $t_3$ and $t_4$, as similar to the time period between $t_1$ and $t_2$, capacitor $C_{101A}$ will be fully charged up and clamped by the parallel diode $D_{101}$ to supply voltage $V_{in}$. Capacitor $C_{101B}$ will be fully discharged from supply voltage $V_{in}$ to a diode drop or virtually 0V. The current waveform flowing through the loading will have a similar waveform as in period between $t_1$ and $t_2$ except for opposite polarity. Also the load current waveform will be similar to that in period between $t_2$ and $t_3$ but with opposite polarity.

The circuit will deliver an averaged power $P_{op}$ to output loading at a switching frequency fs with the following relationship, $$P_{op}=(C_{101A}+C_{101B})fsV_{in}^2, \quad \text{Equation 6}$$

with corresponding equivalent averaged input resistance $R_{in_eq}$ of $$R_{\text{in_eq}} = \frac{1}{(C_{101A} + C_{101B})fs} \quad \text{Equation 7}$$

It should be noticed that the output power and the equivalent input resistance is dependent on the sum of the two series capacitor $C_{101A}$ and $C_{101B}$, it means the two capacitances do not need to be equal or even when one is omit to simplified design, it does not affect the operation and characteristic of the operation. Also the output power and input equivalent is linearly proportional to frequency with no restriction. Hence, one can adjust the output power and input equivalent resistance by adjusting the frequency.

Unlike generic practice, the series inductor $L_{101}$ is not used to create a series resonance in order to pump and limit the energy to the load. The resonance approach needs an exact switching frequency to locate a proper operating point on the bell shape resonant curve in order to control the power and voltage across the load. Most resonant characteristics has a bell shape curve, the control of frequency has to been very stabile and need complicated current feedback control or dedicated IC in actual application. Here the present embodiment controls the output power by means of capacitance but not inductance. The main feature of $L_{101}$ is used to control the current waveform flowing into the load, the configuration will still work even if the inductor $L_{101}$ is omitted. In practice, the value of $L_{101}$ is much smaller than the usual series resonate inductor. $L_{101}$ usually needs only 100 uH to shape the waveform, but other resonant approach usually needs 1 mH to keep the power and current flow into the load.

A small capacitor $C_{102}$ is connected to the filaments of the lamp load to provide a high frequency filter element across the lamp load and also a current path for the filament to heat up and facilitate the ignition of the gas discharged lamp. As an alternative embodiment the capacitor $C_{102}$ can also be split into two series capacitors with the junction node connected to the center tap node to further filter out high frequency noise with respected to the return of the circuit. Secondary windings $W_{102}$ and $W_{103}$ are designed to provide enough voltage to ignite the lamp and give sufficient voltage to maintain operation at steady state operation. The capacitance of $C_{102}$ does not need to have resonant frequency close to the switching frequency, as the transformer $T_{101}$ can provide enough voltage step up to ignite the lamp load and provide enough operating voltage. FIG. 3F shows the voltage waveform across the lamp load $Load_{101}$. It is dependent on the current flow into the $Load_{101}$ and the voltage and current characteristics of $Load_{101}$.

The present embodiment can reduce electromagnetic interference emission. The voltage across the lamp load is actually equal to the sum of the voltage of two secondary center tapped windings $W_{102}$ and $W_{103}$. The windings have equal number of turns and the voltages at the terminals of the lamp load have opposite polarities as the center tapped windings $W_{102}$ and $W_{103}$ have opposite phases with respect to the center tap terminal. As the center tapped terminal of $W_{102}$ and $W_{103}$ is connected to the return of the circuit, and if the stray capacitance of the terminals of the lamp load to earth are equal considering equal length of connection wire and symmetric connection, no resultant current will flow from earth back to the return of the circuit. Otherwise the whole circuit will suffer from a high frequency voltage drop with respect to earth and cause high frequency electromagnetic interference problem.

If electromagnetic interference is not a concern an alternative is to let the center tap node of $W_{102}$ and $W_{103}$ floating and with no connection to other point. This turns the two secondary winding $W_{102}$ and $W_{103}$ to become a single winding. All operations remain the same except that there may be more electromagnetic interference.

Waveforms at the AC input are recap. Node $AC_{101}$ and $AC_{102}$ receive an AC voltage as shown in FIG. 4A, the AC voltage will be rectified to provide a DC rectified voltage across node $V_{101}$ and $V_{100}$ as shown in FIG. 4B. The rectified voltage becomes the supply voltage to the said power module and the complementary switches to deliver determinate power to output loading. If the supply voltage is already a DC voltage, the input rectification circuit $BD_{101}$ becomes unnecessary.

The input current may be slightly imperfect as a sine wave. As the transformer $T_{101}$ has a practical turn ratio limit, if the AC input voltage sinusoidal voltage is close to the zero crossing period, the secondary winding may not have sufficient voltage to sustain normal lamp operation. In FIG. 4C, between the period $\theta_0$ and $\theta_1$, the input voltage is not sufficient to sustain normal operation of the lamp loading. The gas discharge lamp becomes an open circuit. There is not enough current to fully charge and discharge the capacitor $C_{101A}$ and $C_{101B}$. The power feeding operation will not function under this condition. The circuit operation is equivalent to driving a square wave to an open load, hence no current will flow into the converter. Between the period $\theta_1$ and $\theta_2$ the input voltage is high enough to keep normal operation of a gas discharged lamp load, hence the input becomes resistive and the input current follow the wave shape of the input AC voltage. At time $\theta_2$ the voltage sum of winding $W_{102}$ and $W_{103}$ is not enough to sustain the gas discharged lamp and the input current drops to zero. Power will pump to output load in the next AC input cycle while the input voltage is high enough to resume normal operation of a gas discharge lamp.

So far no input high frequency filter is illustrated in FIG. 2 but this is often necessary. It is well known to those skilled in the art to use reactive filter to smooth and average out the high frequency current and produces resistive input characteristic at the input line. No large capacitor, e.g. electrolytic capacitor, is needed to provide a smooth DC voltage. Once the input becomes resistive, a traditional triac type phase control dimmer can be connected in series with the input terminals $AC_{101}$ or $AC_{102}$ to dim and adjust the light intensity of the gas discharge lamp.

Another convenient feature is the output power being linearly proportional to switching frequency. It is very easy to limit the input power when the input AC voltage has exceeded the upper limit. A simple sensing circuit senses the average or instantaneous input voltage and control the switching frequency to limit to control the power to the lamp load. There is no worry about operating outside operation range as most resonant circuit will suffer. Moreover a simple sensing circuit can sense the instantaneous input voltage and control the switching frequency to improve the input and output current crest factor. All these are possible and easy to implement in the present invention.

It will be appreciated that the various features described herein may be used singly or in any combination thereof. Therefore, the present invention is not limited to only the embodiments specifically described herein. While the foregoing description and drawings represent a preferred embodiment of the present invention, it will be understood that various additions, modifications, and substitutions may be made therein without departing from the spirit of the present invention. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive.

What is claimed is:

1. A power conversion apparatus for a non-linear load, comprising:

a pair of input terminals for connection to a DC voltage source;

a first and a second capacitor connected in series coupled to said pair of input terminals;

a first and a second diode coupled in parallel with said first and second capacitors respectively such that the diodes are reverse biased under said DC voltage source;

an inductor coupled to a first node connecting said capacitors and diodes;

a transformer comprising at least one primary winding and two secondary windings, said transformer having its primary winding coupled to said inductor and its secondary windings coupled in series at a second node, said secondary windings being constructed in a way to produce voltages with opposite polarities with respect to said second node coupling these two windings;

a third terminal coupled to said primary winding of said transformer, for connection to a pulsating voltage source, such voltage source charging or discharging said first and second capacitors within one pulsating cycle; and a non-linear load coupled to said secondary windings for electrical power.

2. The apparatus according to claim 1 further comprising means to couple said node joining said transformer secondary windings to one of the said input terminals.

3. The apparatus according to claim 1 having a discharge lamp as said non-linear load, further comprising a capacitor at said lamp load terminals to facilitate lamp operations.

4. The apparatus according to claim 1 having a discharge lamp as said non-linear load, further comprising:

two series capacitors at said lamp load terminals to facilitate lamp operations;

a node coupling said two series capacitors; and means to couple said node to one of said input terminals.

5. The apparatus according to claim 1, further comprising:

means for controlling the frequency of said pulsating voltage source coupled to said third terminal for control of output power.

6. A power conversion apparatus for a non-linear load, comprising:

a pair of input terminals for connection to a DC voltage source;

a first and a second capacitor connected in series coupled to said pair of input terminals;

a first and a second diode coupled in parallel with said first and second capacitors respectively such that the diodes are reverse biased under said DC voltage source;

a first node connecting said capacitors and diodes;

a transformer comprising at least one primary winding and two secondary windings, said transformer having its primary winding coupled to said first node and its secondary windings coupled in series at a second node, said secondary windings being constructed in a way to produce voltages with opposite polarities with respect to said second node coupling these two windings;

a third terminal coupled to said primary winding of said transformer, for connection to a pulsating voltage source, such voltage source charging or discharging said first and second capacitors within one pulsating cycle; and a non-linear load coupled to said secondary windings for electrical power.

7. The apparatus according to claim 6 further comprising means to couple said node joining said transformer secondary windings to one of the said input terminals.

8. The apparatus according to claim 6 having a discharge lamp as said non-linear load, further comprising a capacitor at said lamp load terminals to facilitate lamp operations.

9. The apparatus according to claim 6 having a discharge lamp as said non-linear load, further comprising:

two series capacitors at said lamp load terminals to facilitate lamp operations;

a node coupling said two series capacitors; and means to couple said node to one of said input terminals.

10. The apparatus according to claim 6, further comprising:

means for controlling the frequency of said pulsating voltage source coupled to said third terminal for control of output power.

11. A power conversion apparatus for a non-linear load, comprising:

a pair of input terminals for connection to a DC voltage source;

a first and a second diode connected in series and coupled to said DC voltage source such that each diode is reverse biased under said DC voltage source;

a first capacitor connected in parallel to either of the said diodes;

an inductor coupled to a first node connecting said diodes;

a transformer comprising at least one primary winding and two secondary windings, said transformer having its primary winding coupled to said inductor and its secondary windings coupled in series at a second node, said secondary windings being constructed in a way to produce voltages with opposite polarities with respect to said second node coupling these two windings;

a third terminal coupled to said primary winding of said transformer, for connection to a pulsating voltage source, such voltage source charging or discharging said first capacitor within one pulsating cycle; and a non-linear load coupled to said secondary windings for electrical power.

12. The apparatus according to claim 11 further comprising means to couple said node joining said transformer secondary windings to one of the said input terminals.

13. The apparatus according to claim 11 having a discharge lamp as said non-linear load, further comprising a capacitor at said lamp load terminals to facilitate lamp operations.

14. The apparatus according to claim 11 having a discharge lamp as said non-linear load, further comprising:

two series capacitors at said lamp load terminals to facilitate lamp operations;

a node coupling said two series capacitors; and means to couple said node to one of said input terminals.

15. The apparatus according to claim 11, further comprising:

means for controlling the frequency of said pulsating voltage source coupled to said third terminal for control of output power.

16. A power conversion apparatus, comprising:

a rectifier module for connection to an AC source and having a pair of output terminals which deliver a direct current;

a pair of series switches coupled to said pair of rectifier module output terminals for acceptance of said direct current, switching of said switches produces a pulsating DC source at a first node;

means for coupling said first node with pulsating DC to a primary winding of a transformer, wherein said transformer comprises two secondary windings, said transformer having its primary winding coupled to an inductor and its secondary windings coupled in series at a second node, wherein the secondary windings are coupled with the primary winding to produce voltages of opposite polarities with respect to said second node; and means for coupling the output terminals of said rectifier module to a first and a second capacitor connected in series at a third node, each capacitor coupled in parallel with a respective diode such that the diodes are reverse biased under said rectifier module, and the inductor is coupled to the third node.

* * * * *